US005421459A

United States Patent [19]

Mazzotti

[11] Patent Number: 5,421,459

[45] Date of Patent: Jun. 6, 1995

[54] MULTICOMPARTMENT TRAY

[76] Inventor: Massimo Mazzotti, Via S. Francesco d'Assisi 94, Cesena (Forlì), Italy, 47023

[21] Appl. No.: 191,256

[22] Filed: Feb. 2, 1994

[30] Foreign Application Priority Data

Feb. 12, 1993 [IT] Italy ..... BO93U0021

[51] Int. Cl.[6] ..... A45C 11/20

[52] U.S. Cl. ..... 206/549; 206/563; 206/564

[58] Field of Search ..... 206/549, 561, 562, 563, 206/564

[56] References Cited

U.S. PATENT DOCUMENTS

| | | | |
|---|---|---|---|
| D. 162,860 | 4/1951 | Mercer | 206/564 X |
| D. 194,114 | 11/1962 | Graham | 206/564 |
| 2,240,020 | 4/1941 | Raiser | 206/561 X |
| 3,498,470 | 3/1970 | Thomas | 206/564 |
| 4,343,428 | 8/1982 | Persson . | |
| 4,732,274 | 3/1988 | Bouton | 206/561 |
| 4,823,958 | 4/1989 | Mahmud | 206/561 |
| 4,867,331 | 9/1989 | Task | 206/564 |
| 5,170,908 | 12/1992 | Austin | 206/563 |
| 5,259,528 | 11/1993 | Pace et al. | 206/561 |

FOREIGN PATENT DOCUMENTS

| | | | |
|---|---|---|---|
| 551557 | 1/1958 | Canada | 206/561 |
| 744258 | 10/1966 | Canada | 206/564 |
| 1103185 | 2/1968 | United Kingdom | 206/562 |
| 20586 | 11/1992 | WIPO | 206/549 |

*Primary Examiner*—David T. Fidei
*Attorney, Agent, or Firm*—Hoffmann & Baron

[57] ABSTRACT

The multi-compartment tray exhibits a support and containment plane provided with a plurality of compartments, of which one compartment extends beneath the support and containment plane, thereby constituting a manual grip for the tray, while contemporaneously providing a suitable seating for a cup or can.

11 Claims, 2 Drawing Sheets

MULTICOMPARTMENT TRAY

BACKGROUND OF THE INVENTION

The invention relates to a multi-compartment tray suitable for bearing foods and drinks.

The prior art embraces multi-compartment trays which are used for serving various types of foods making up a single meal, for example a main course with vegetables and a drink in a cup. Generally this type of tray is used in bars, diners and fast food outlets or the like, especially where a self-service system exists, and is used at least for carrying the food from a serving line to a table. Normally, for the above purpose flat disposable trays are used, provided with dividers on their upper face which can be used for containing food either directly or indirectly, that is having further single plastic or paper food containers perched on them with no special hand-gripping means provided: indeed, only in very few cases do these trays provide lateral handles for holding the tray during transport. The invention described in U.S. Pat. No. 4,343,428 does actually exhibit handles, though not compartments or dividers. In all cases the drinks container is simply rested on the plane of the tray or, as in the case of trays used in aircraft, a shallow recess is provided which has the sole aim of limiting transversal movements of the container itself due to the movements of the aircraft.

In other cases attachments are envisaged, applicable to specific supports such as automobile windows or doors, as used in drive-in cinemas. These trays present drawbacks whenever it becomes necessary to eat while standing, or while sitting but without a table to rest the tray on, as can happen when, for example, a fast-food outlet is crowded, or when snacks are bought at a cinema or in a sports stadium. In the above cases, a traditional tray is very awkward or downright impossible to handle, the only grips (if any) for the tray being lateral and on the same plane as the tray upper surface, thus not offering an adequate positioning of the hand to balance the tray and its contents. Also, when transporting the tray in one hand together with a drink held in the other, balancing the tray becomes a significant problem once more.

The principal aim of the present invention is to obviate the above-mentioned drawbacks by providing a multi-compartment tray exhibiting a support plane equipped with a plurality of compartments, of which one extends below the support and containment plane, constituting a gripping element for the tray and at the same time providing a suitable seating to receive a drink container.

SUMMARY OF THE INVENTION

The invention, as it is characterised in the claims that follow, solves the above-mentioned problems by providing a tray that can be held in one hand only and which leaves the other hand free for handling the food on the tray itself. One of the advantages offered by the invention is that the drink container is inserted into the same compartment that constitutes the tray gripping element, which compartment also serves as a safe seating for the drink in the tray when the user wishes to have his or her second hand free.

BRIEF DESCRIPTION OF THE DRAWINGS

Further characteristics and advantages of the present invention will better emerge from the detailed description that follows, of a preferred but non-exclusive embodiment here illustrated in the form of a non-limiting example in the accompanying drawings, in which.

DESCRIPTION OF THE PREFERRED EMBODIMENTS

Figure 1:
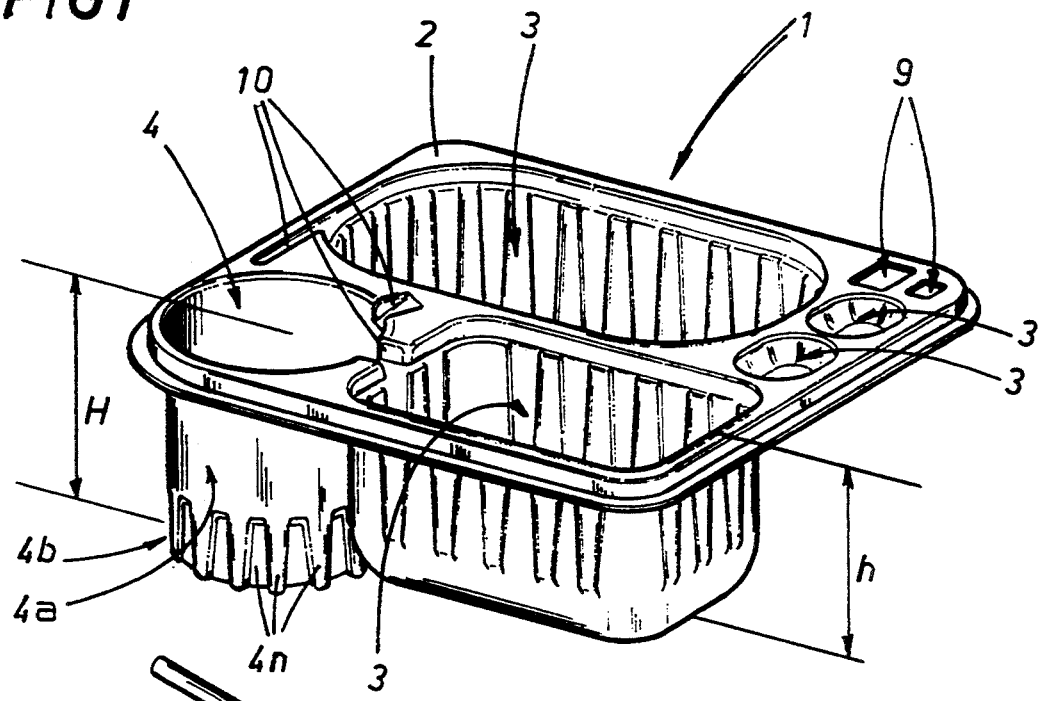
FIG. 1 is a schematic perspective view showing a preferred embodiment of a multi-compartment tray according to the invention.

With reference to the figures, the tray 1 of the invention is constituted by a support and containment plane 2, which can have the most suitable dimensions according to need.

The tray 1 is made in a single piece by printing out of plastic material suitable for use with foodstuffs and exhibits a plurality of compartments or sections 3 and 4, separate among themselves and destined to contain different foods or drinks (or cans). The tray 1 extends below the tray 1 plane by a distance h.

One of the compartments, advantageously the compartment 4 which will receive the drink container 6, has a truncoconical shape (to receive a traditionally-shaped cup of that shape) or a circular section (for a can) and extends below the support plane 2 by a distance H, which is greater than distance h of the remaining compartments, in order that the said compartment 4 can be used as a grip for the whole tray 1. This compartment 4 is of a shape and dimensions such as to receive a part of the drink container 6 and can also exhibit differentiated transversal sections (denoted by **4*a* and 4*b*) so that it can be adapted to receiving differently-shaped drink containers. There are also vertical ribs 4*n* inside the compartment 4, which serve both to stabilize the container 6 in the compartment 4 and stiffen the whole compartment 4, improving its functionability as a grip. The elastic quality of the ribs 4*n* also makes the compartment 4** more flexible in receiving drink containers of different shapes.

Thus it is possible to hold the entire tray simply by gripping the compartment 4 with one hand 10 (see FIG. 2), while eating with the other hand. The presence of a cup or a can in the compartment 4 indeed contributes to the rigidity of the whole gripping compartment 4.

Figure 2:
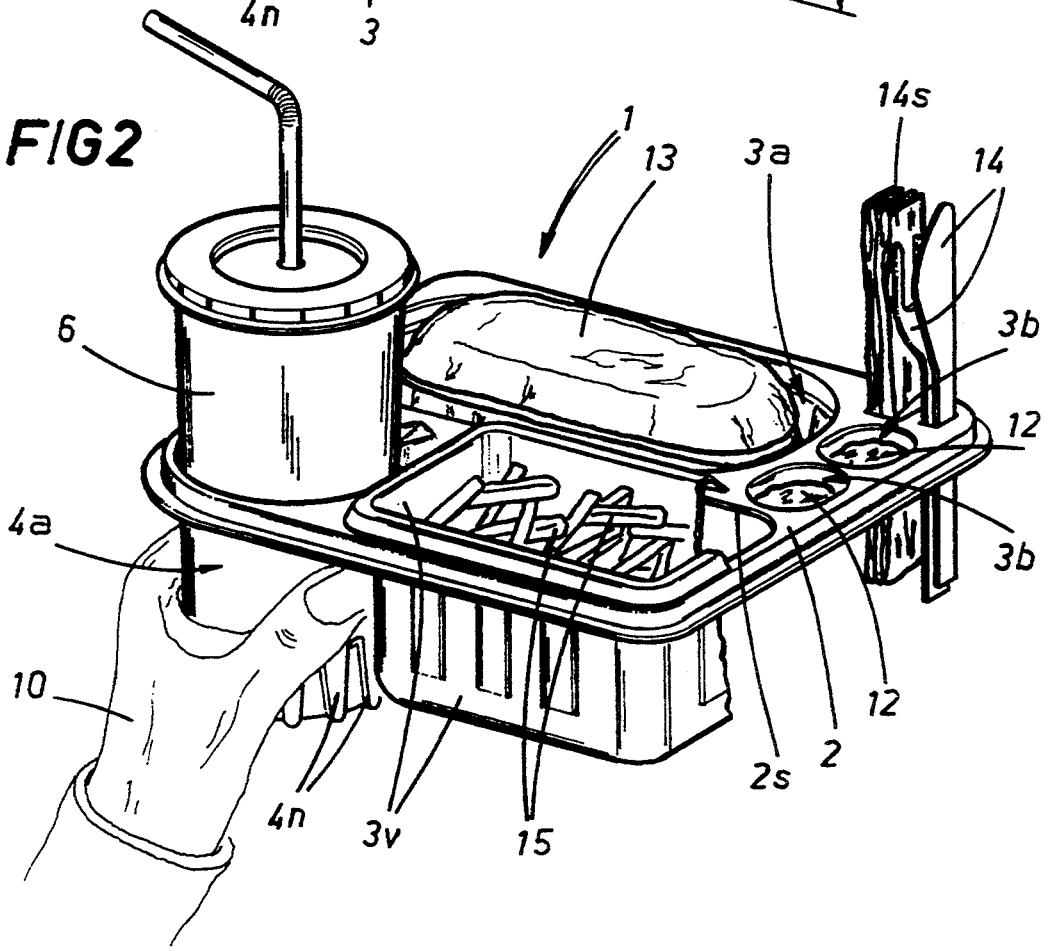
FIG. 2 is a schematic perspective view showing the embodiment of FIG. 1, with some design differences, in use.

For simplicity's sake, the meal in FIG. 2 is represented by bread 13, French fried potatoes 15 in compartments **3*a* and sauces or relishes 12 in compartments 3*b*. The support and containment plane 2 can also exhibit one or more through-holes 9, in which cutlery 14 and a napkin 14*s*** can be lodged.

Figure 5:
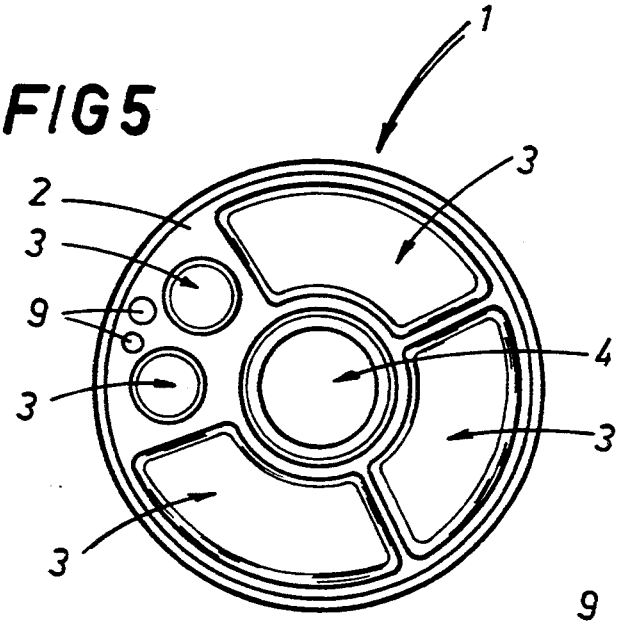
FIGS. 5 and 6 are schematic plan views from above of further embodiments of the tray of the invention.
Figure 6:
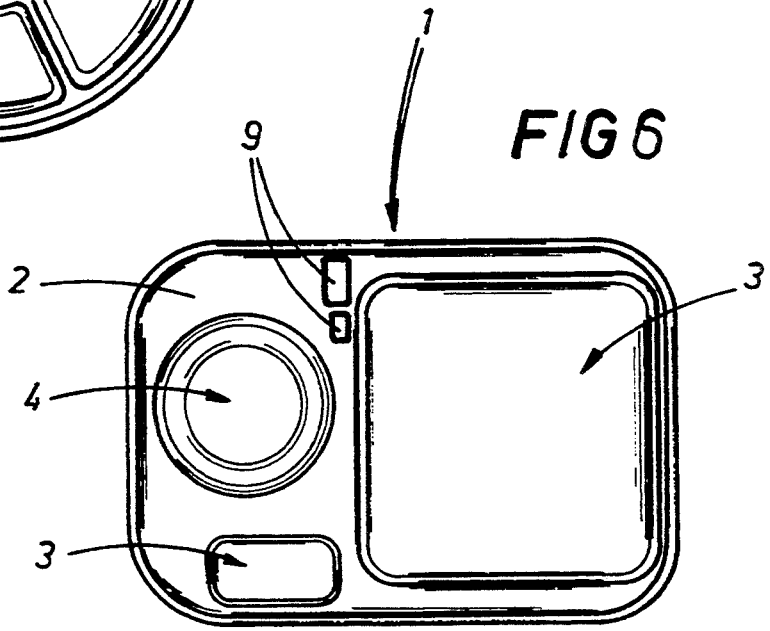

If the tray 1 is rectangular or quadrilateral in shape, or in any case exhibits sharp edges, (see FIGS. 1, 2, 3, and 6) the compartment 4 defining the grip will preferably be in a portion near one of the sharp edges, while if the tray 1 is circular, as in FIG. 5, the compartment 4 will be better placed in the center of the tray 1.

Figure 3:
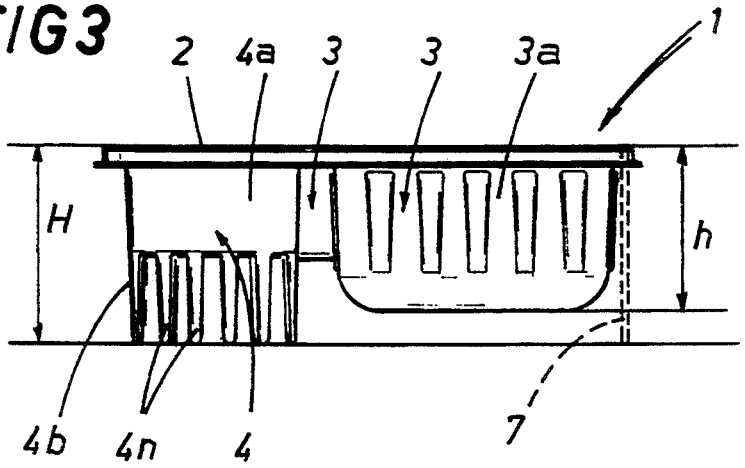
FIG. 3 shows a lateral view of the embodiment of FIG. 1.
Figure 4:
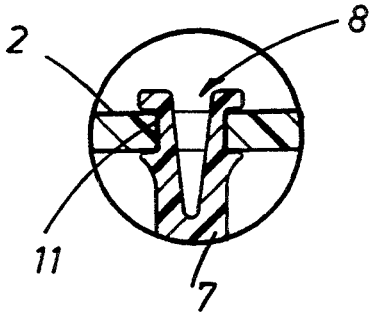
FIG. 4 is an enlarged view of a detail of a rest foot of the tray.

In FIGS. 3 and 4 it can be seen how the tray 1 can be equipped with support feet 7 which extend below the support and containment plane 2 by a distance equal to the height H of the compartment 4, so that the tray 1 can be stably placed on a plane, such as a table, should such an opportunity arise.

The feet 7 can be in a single piece with the support and containment plane 2, as shown by a broken line in FIG. 3, and are preferably separable from the plane 2 by a tearing action. Alternatively, as shown in FIG. 4, the two pieces are engageable to each other by means of a tab-through hole engagement, such as, for example, an end 8 applicable by pressure and constituted by elements which can be elastically engaged to each other by temporarily reducing the diameter of the end 8 to insert it into the through-holes 11, releasing the elements thereafter to achieve engagement.

The multi-compartment tray 1 is preferably printed in a single piece of plastic material, and exhibits a single-body support and containment plane 2 in a single body together with the compartments 3 and 4. For special needs relating to transport, stacking or manufacture, it could be made in a frame functioning both as a support and containment plane 2 and as a drinks cup containment compartment, at least instead of the compartments 3*a*, provided with simple through-seatings 2*s* into which independent traylets 3*v* can be inserted (see FIG. 2). Further, since the gripping element 4 must support the whole weight of the food and also withstand the forces applied on the plane 2 while the customer is eating, further stiffening ribs 10 are included internally of the compartment housing (see FIG. 1).

In a preferred embodiment, the upper and lower faces of the tray are complementary such that 10 they can be inserted one on top of another to form piles, leading to obvious advantages when they are to be transported.

What is claimed:

1. A multicompartment tray comprising:

a support and containment plane, said plane having a support and containment plane area;

first compartment defining means defining a first main food compartment, the first compartment defining means extending below said support and containment plane by a first depth, the first compartment defined by the first compartment defining means occupying a space which is at least half of said support and containment plane area;

second compartment defining means defining a second compartment, the second compartment defining means having a bottom portion, the second compartment defining means extending below said support and containment plane by a second depth, said second depth being greater than said first depth, the second compartment defining means having at least a portion thereof formed with a tapered cross section and the second depth associated with the second compartment defining means being dimensioned to accommodate a beverage container and to provide a hand grip for a user of the tray, the second compartment defining means being located in a peripheral portion of said support and containment plane;

third compartment defining means defining a third compartment, the third compartment defining means extending below said support and containment plane by a third depth, the third compartment defined by the third compartment defining means being provided to contain at least one of a sauce and a relish; and means defining through holes formed in the support and containment plane, the through holes being dimensioned to receive at least one of a napkin and cutlery.

2. A multicompartment tray comprising:

a circular support and containment plane, said plane having an area and a center;

first compartment defining means defining a first main food compartment, the first compartment defining means extending below said support and containment plane by a first depth;

second compartment defining means defining a second compartment, the second compartment defining means having a bottom portion, the second compartment defining means extending below said support and containment plane by a second depth, said second depth being greater than said first depth, the second compartment defining means having at least a portion thereof formed with a tapered cross section and the second depth associated with the second compartment defining means being dimensioned to accommodate a beverage container and to provide a hand grip for a user of the tray, the second compartment defining means being located in the center of said support and containment plane;

third compartment defining means defining a third compartment, the third compartment defining means extending below said support and containment plane by a third depth, the third compartment defined by the third compartment defining means being provided to contain at least one of a sauce and a relish; and means defining through holes formed in the support and containment plane, the through holes being dimensioned to receive at least one of a napkin and cutlery.

3. A multicompartment tray as in claim 1, wherein at least the second depth is greater than the third depth and wherein the second compartment defined by the second compartment defining means has a circular section which is adapted to receive at least partially a beverage container having a circular section.

4. A multicompartment tray as in claim 1, wherein the support and containment plane and the first compartment defining means, the second compartment defining means and the third compartment defining means are realized in a single body.

5. A multicompartment tray as in claim 1, wherein the second compartment defined by the second compartment defining means includes a plurality of transverse sections, such that the second compartment can receive beverage containers having different diameters.

6. A multicompartment tray as in claim 1, further comprising at least two feet which extend below the support and containment plane by at least a depth equal to the second depth, in order that the tray may be stably positioned on a plane.

7. A multicompartment tray as in claim 6, wherein the at least two feet are realized in a single body together with the support and containment plane.

8. A multicompartment tray as in claim 6, wherein the at least two feet are detachably mounted on the support and containment plane, each of the at least two feet being received by a through-hole formed in the support and containment plane, and wherein the at least two feet have ends, said ends having fixing means for stably fixing the at least two feet to the support and containment plane.

9. A multicompartment tray as in claim 1, wherein said tray has a lower and an upper face, said faces being shaped in such a way that a plurality of such multicompartment trays can be stacked one on top of another.

10. A multicompartment tray as in claim 1, wherein the support and containment plane and at least the second compartment defining means are realized in a single body; and wherein the support and containment plane is further provided with a plurality of through-seatings destined to receive a plurality of traylets containing foodstuffs.

11. A multicompartment tray as in claim 1, further comprising stiffening ribs, said stiffening ribs being located at least on said second compartment defining means.

* * * * *